US005996295A

United States Patent [19]

Merkle

[11] Patent Number: 5,996,295

[45] Date of Patent: Dec. 7, 1999

[54] ADJUSTABLE PIPE SUPPORTING BRACKET

[76] Inventor: Larry S. Merkle, 7880 Salt Rd., Clarence Center, N.Y. 14032

[21] Appl. No.: 08/859,557

[22] Filed: May 20, 1997

Related U.S. Application Data

[60] Provisional application No. 60/018,046, May 21, 1996.

[51] Int. Cl.[6] ..... E04C 2/52

[52] U.S. Cl. ..... 52/220.8

[58] Field of Search ..... 248/65, 74.4, 74.1, 248/230.5, 228.5, 231.61, 316.6, 212; 52/220.8, 712, 27, 713; 138/106, 107

[56] References Cited

U.S. PATENT DOCUMENTS

| | | | |
|---|---|---|---|
| 35,802 | 7/1862 | Douglas | 248/74.4 |
| 492,593 | 2/1893 | Taylor | 248/74.4 |
| 3,357,664 | 12/1967 | Geyer | 248/74.4 |
| 4,020,531 | 5/1977 | Ahrens et al. | 248/74.4 X |
| 4,281,213 | 7/1981 | Sciscione | 248/74.4 X |
| 4,848,452 | 7/1989 | McDonald et al. | 248/65 X |
| 4,928,911 | 5/1990 | Hardtke | 248/74.4 X |

FOREIGN PATENT DOCUMENTS

| | | | |
|---|---|---|---|
| 106533 | 6/1965 | Norway | 248/230.5 |

*Primary Examiner*—Leslie A. Braun
*Assistant Examiner*—Stephen S. Wentsler
*Attorney, Agent, or Firm*—Hodgson Russ Andrews Woods & Goodyear LLP

[57] ABSTRACT

A pipe supporting brace is provided which may be affixed to an interior pipe and adjusted such that a faucet mounted on an exterior wall, and coupled to the interior pipe is brought into secure engagnement with the exterior wall.

3 Claims, 2 Drawing Sheets

ADJUSTABLE PIPE SUPPORTING BRACKET

This application was filed as a provisional application, Ser. No. 60/018,046, filed May 21, 1996.

BACKGROUND OF THE INVENTION

1. Field of the Invention

This invention relates to brackets and braces for supporting pipes and the like and particularly to such hangers for securely gripping and supporting pipes in a fixed relationship to a supportive surface.

2. Prior Art

It is often desirable to affix a faucet to an exterior wall, or other exterior mounting surface of a home or other building structure such that water or other liquid may be conveyed from a source interior to the building and made available for exterior use through the faucet. To accomplish this, the faucet is coupled to an interior liquid conveying pipe through the exterior wall or mounting surface. Such faucets must be installed on the exterior of the building and securely affixed to and supported from the wall or other mounting surface to insure proper operation.

A common means of supporting a faucet securely against an exterior mounting surface is a support flange. Typical support flanges include a central opening through which an end of the faucet is passed. On either side of the central opening are smaller openings through which screws or other fastening means may be passed in order to secure the flange to the exterior wall.

One disadvantage of this method of supporting a faucet is the tendency of the fastening means to loosen and in some cases separate from the flange itself, thereby decreasing the effectiveness of the flange. As a result the faucet may become loose or unstable.

SUMMARY OF THE INVENTION

It is a principal object of the present invention to provide a pipe supporting bracket mountable on an inside wall of a building for maintaining a fluid conveying pipe in secure engagement with a faucet mounted on a corresponding outside wall of the building.

BRIEF DESCRIPTION OF THE DRAWINGS

Other objects and advantages of this invention will become apparent from the following description taken in connection with the accompanying drawings wherein are set forth by way of illustration and example, a certain embodiment of is invention.

DESCRIPTION OF THE PREFERRED EMBODIMENTS

While the invention will be described in connection with the preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
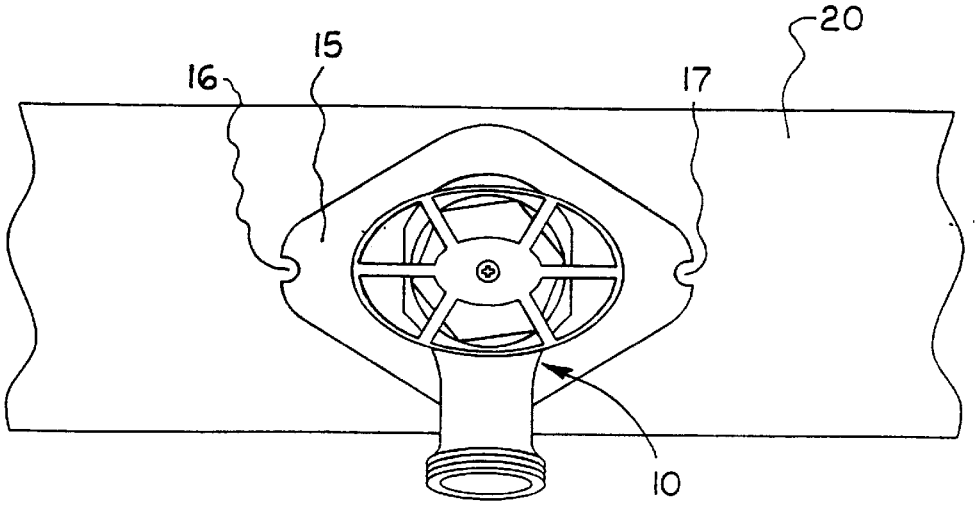
FIG. 1 is a front elevation view of a typical faucet, and faucet support flange shown attached to an exterior wall.

FIG. 1 shows a typical faucet 10 projecting from an exterior wall, or other exterior mounting surface 20 and secured in a position by means of support flange 15. Support flange 15 is normally affixed to exterior wall 20 by means of screws (not shown) inserted through support flange 15 at openings 16 and 17. To achieve installation of the faucet, three or more openings must be cut or drilled into exterior wall 20. One large central opening must be cut to allow the end of faucet 10 to be inserted through exterior wall 20 to connect to a water pipe, or other fluid conveying pipe. Two or more smaller openings must be drilled into exterior wall 20 near the central opening to align with openings 16 and 17 in support flange 15 in order to accommodate screws.

In many cases the close proximity of these openings causes problems in that the material of exterior wall 20 between the smaller openings and the larger central opening can crumble or otherwise degrade upon drilling the holes for the screws. This degradation in wall 20 can cause the screws to become loose or fall out entirely, resulting in loss of effectiveness of support flange 15. Faucet 10 then becomes loose or unstable.

Figure 2:
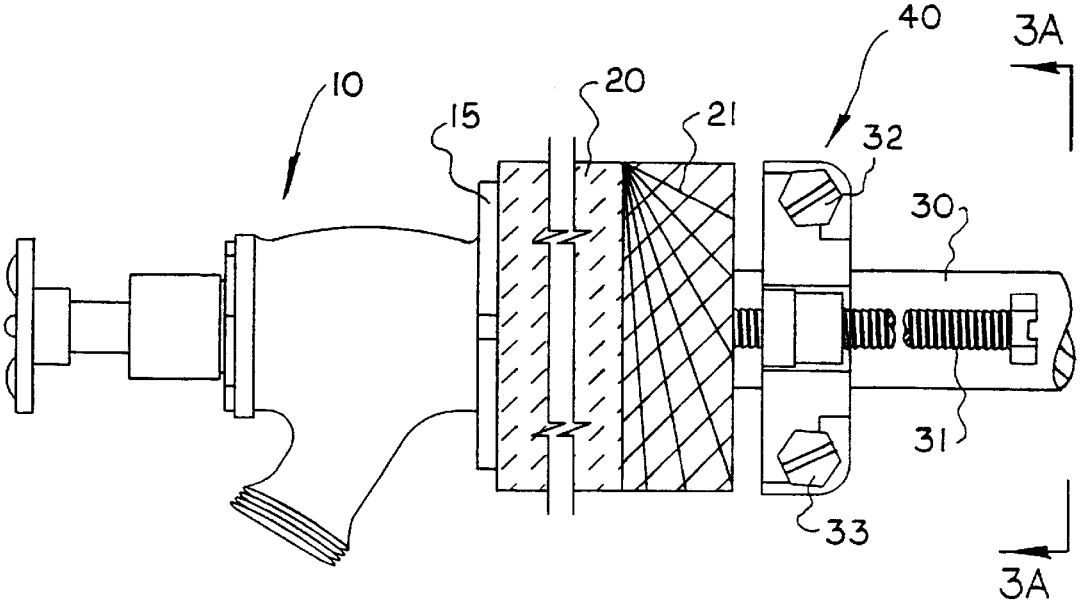
FIG. 2 is a side elevation view of the faucet shown in FIG. 1, as it appears affixed to a fluid conveying pipe supported by the pipe supporting bracket of the present invention.

The pipe supporting bracket of the present invention provides a means for holding pipe 30 securely in place against interior wall 21, thereby stabilizing faucet 10. FIG. 2 shows a side view of faucet 10, support flange 15, exterior wall 20, interior wall 21, and a fluid conveying pipe 30 supported by pipe supporting bracket 40 of the present invention, Bracket 40 is affixed to pipe 30 and supported against inner wall 21 by support screws 31 and 36 (31 shown). In the preferred embodiment two support screws are used. Alternatively, more than two support screws could be used to brace pipe supporting bracket 40 against inner wall 21.

Figure 3A:
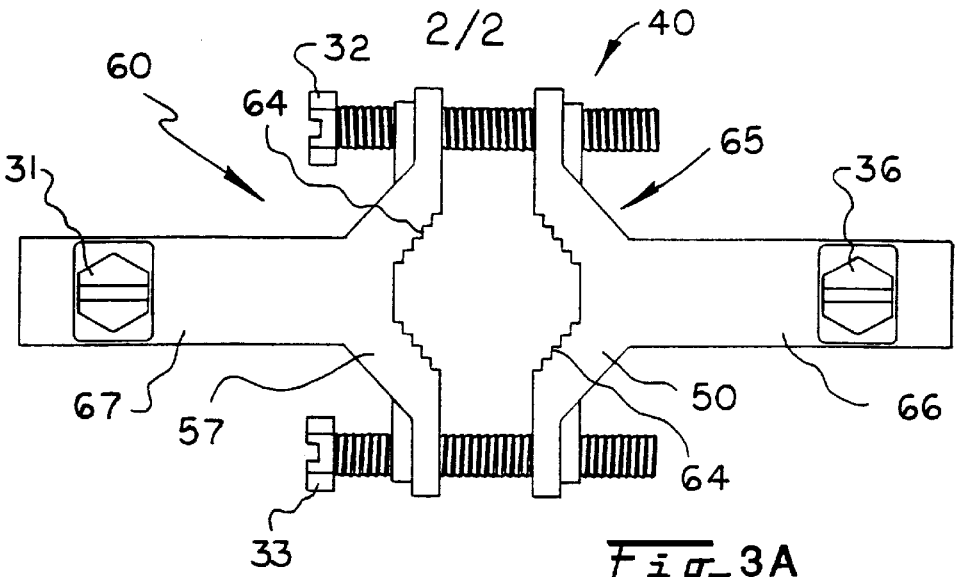
FIG. 3A shows a rear elevation view of the pipe supporting bracket as seen from direction 3A—3A of FIG. 2, and from the interior of a building structure.

FIG. 3A shows a rear view of bracket 40 as seen from direction 3A—3A of FIG. 2. Bracket 40 is comprised of two substantially identical cooperating pieces, or members 60 and 65. Each of members 60 and 65 may be molded as a single piece and preferably constructed from a non ferrous aluminum material. Likewise, materials such as zinc alloys, or other materials having sufficient strength and rigidity to withstand the forces exerted by pipe 30 and faucet 10 while holding pipe 30 and faucet 10 securely in place may be used in construction These remain within the scope of the present invention.

Cooperating members 60 and 65 include yoke portions 50 and 57 which are adapted to be placed around a pipe, then coupled to each other and adjusted to securely engage the pipe by means of adjusting screws 32 and 33. Yoke portions 50 and 57 are provided with openings (not shown) at both ends for passing adjusting screws 32 and 33 therebetween. In a preferred embodiment of the invention the opening for passing screws 32 and 33 in yoke portion 50 is a threaded opening, while the opening for passing screws 33 and 32 in yoke portion 57 is not threaded. In all other respects cooperating members 60 and 65 may be identical Yoke portions 50 and 57 may be provided with a pipe gripping surface 64 for securely gripping a pipe to be supported.

To secure a pipe within pipe supporting bracket 40 cooperating members 60 and 65 are positioned in opposition to one another around the pipe to be secured such that pipe gripping portions 64 are in secure contact with the outer surface of the pipe. Adjusting screws 32 and 33 are tightened to so that the bracket 40 is securely clamped around the pipe to be supported.

Extending laterally from yoke portions 50 and 57, and formed integrally therewith, are elongate arms 66 and 67. Arms 66 and 67 are each provide with an opening, which is preferably threaded, at their distal end for passing a screw, or other fastening means therethrough.

Bracing screws 31 and 36 are extended through the threaded openings on arms 66 and 67 and are brought to rest on the interior wall against which bracket 40 is to be braced. Bracing screws 31 and 36 may then be adjusted until the desired engagement of faucet 10 with exterior wall 20 is achieved. As bracing screws 31 and 36 are tightened, bracket 40, and therefore pipe 30, moves away from interior wall 21. Therefore, faucet 10, which is coupled to pipe 30 is brought into tighter engagement with exterior wall 20.

Figure 3B:
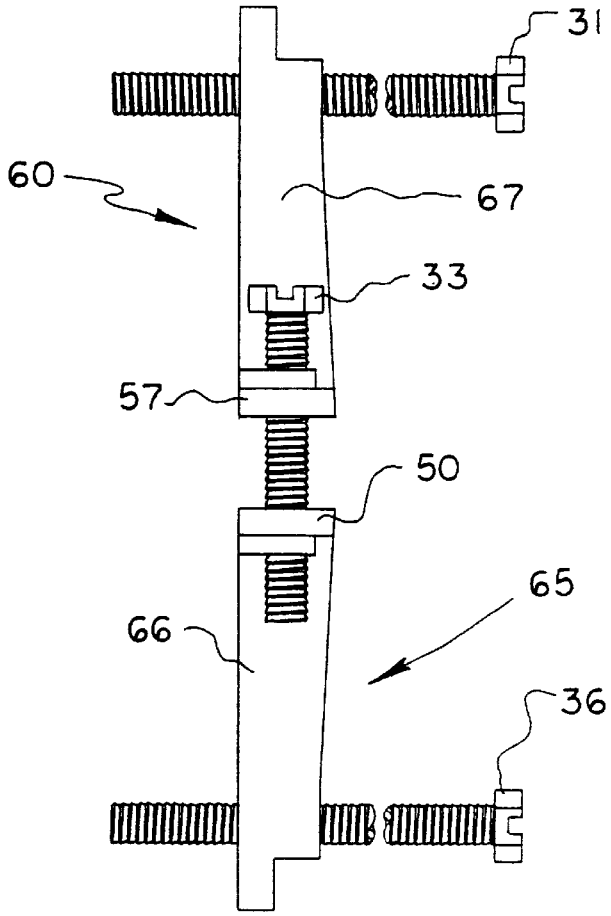
FIG. 3B shows a top plan view of the pipe supporting bracket of FIG. 3A.

FIG. 3B shows bracing screws 31 and 36 from a side view. Bracing screws 31 and 36 are located at the distal ends of elongated rectangular arm portions 66 and 67 of pieces 60 and 65. The length of rectangular arm portions 66 and 67 should be such that the pipe to be supported is held securely in position when bracing screws 31 and 36 are extended to the exterior wall.

Bracing screws 31 and 36 can be of any length, and their length can be adjusted so that bracket 40 can be placed at any desired distance from interior wall 21, and faucet 10 can be brought into secure engagement with exterior wall 20.

FIG. 3B shows adjusting screw 33 and pieces 60 and 65 from a top view. Pieces 60 and 65 may be thicker at yoke portions 50 and 57 and may gradually narrow towards the distal ends of arms 66 and 67. However, any thickness, or taper, can be used which provides sufficient support and rigidity for bracket 40 while accommodating bracing screws 31 and 36 and adjusting screws 32 and 33.

While the invention has been described in conjunction with this embodiment, it is illustrative only. Accordingly, many alternatives, modifications and variations will be apparent to persons skilled in the art in light of the foregoing detailed description. The foregoing description is intended to embrace all such alternatives and variations falling within the spirit and broad scope of the invention.

I claim:

1. A pipe supporting bracket for supporting a pipe disposed through a support structure, the pipe supporting bracket comprising:

two cooperating members, each member including a yoke portion which is adapted to be placed around the pipe, each said yoke portion having a pair of openings;

a pair of fastening members fastening said yoke portions together to surround and securely engage said pipe, said yoke portions when secured together forming an opening for the pipe to extend therethrough and said opening being substantially orthogonal to said fastening members; and each of said yoke portions having a third opening that is threaded with a bracing threaded member located therein, said bracing threaded members being substantially parallel to said opening for said pipe;

wherein said pipe supporting bracket is adapted to be secured to the pipe and said bracing threaded members are adapted to be adjusted against the support structure in a first direction such that a reaction between said pipe, said support structure and said pipe supporting bracket is adapted to cause the pipe to force a faucet on an opposite side of the support structure to abut against said support structure.

2. The pipe supporting bracket of claim 1, wherein each yoke portion further comprises an elongate arm portion extending laterally.

3. The pipe supporting bracket of claim 2, wherein the bracing threaded member extends from the arm portion.

* * * * *